United States Patent [19]

Bull

[11] Patent Number: 4,897,302

[45] Date of Patent: Jan. 30, 1990

[54] SPORTING SURFACES

[75] Inventor: Paul F. Bull, Bellbowrie, Australia

[73] Assignee: A. V. Syntec Pty Ltd., Queensland, Australia

[21] Appl. No.: 283,450

[22] PCT Filed: Mar. 16, 1988

[86] PCT No.: PCT/AU88/00069

§ 371 Date: Nov. 17, 1988

§ 102(e) Date: Nov. 17, 1988

[87] PCT Pub. No.: WO88/06971

PCT Pub. Date: Sep. 22, 1988

[30] Foreign Application Priority Data

Mar. 18, 1987 [AU] Australia ..... PI0927

[51] Int. Cl.[4] ..... B32B 5/16

[52] U.S. Cl. ..... 428/283; 427/212; 427/407.1; 427/407.3; 428/17; 428/95; 428/304.4; 428/317.9; 428/327

[58] Field of Search ..... 428/17, 95, 283, 304.4, 428/317.9, 327; 427/212, 407.1, 407.3

[56] References Cited

U.S. PATENT DOCUMENTS 4,054,706 10/1977 Shapiro ..... 428/304.4

*Primary Examiner*—William J. Van Balen

*Attorney, Agent, or Firm*—Armstrong, Nikaido, Marmelstein, Kubovcik & Murray

[57] ABSTRACT

A synthetic sporting surface for tennis courts comprises a laminate of (1) a porous base layer formed from a matrix of liquid polyurethane mixed with resilient particles; (2) a polymeric sealant which seals the upper porous surface of the base layer; (3) a fiber reinforced adhesive layer on the upper surface of the sealant; and (4) an acrylic top coat which acts as a wear layer on the upper surface of the sealant. The fiber-reinforced adhesive layer comprises an adhesive having reactive sites capable of bonding the sealant and the acrylic top coat to provide a durable cushioned playing surface.

13 Claims, 1 Drawing Sheet

SPORTING SURFACES

Figure 1:
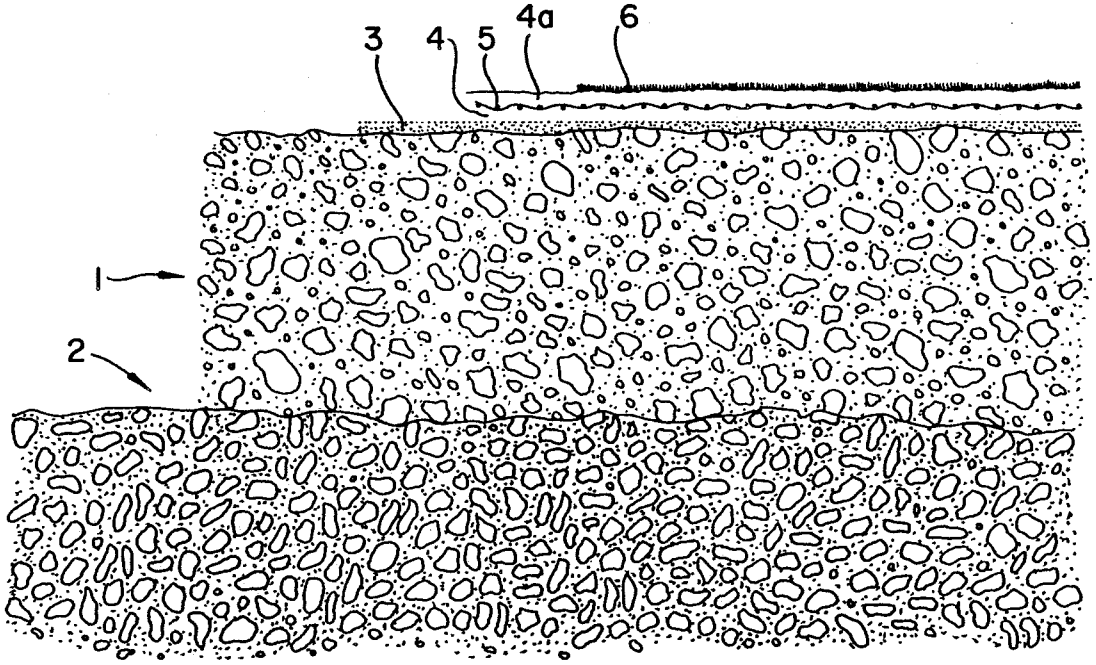

THIS INVENTION is concerned with synthetic sporting surfaces and particularly although not exclusively sporting surfaces suited to the game of tennis.

There are many synthetic sporting surfaces which purport to combine advantages of natural playing surfaces such as grass, clay, cinders, etc. with advantages of synthetic materials such as wearability, weatherability and the like. Prior art synthetic sporting surfaces may be broadly classified in two groups:

artificial turf comprising tufted fibrous material, and;

solid surfaces comprising a cushioned or stiff integral layer of a synthetic material.

The present invention is concerned with surfaces of the "solid" type although it should be understood that for many sporting applications surfaces according to the invention may be superior to "artificial turf" sporting surfaces.

Previously known "solid" sporting surfaces may be broadly categorized as "cushioned" and "hard" surfaces.

Of the prior art cushioned surfaces the most effective and most durable, comprise a cast layer of liquid polyurethane polymer containing particles of a resilient material such as pulverized rubber from reclaimed motor car tyres and the like and these surfaces may be constructed as solid or porous structures.

A solid structure may typically comprise a polyurethane liquid polymer containing pulverized rubber particles having a particle size in the range 2 mm–5 mm in the ratio of about 10 parts by weight of polymer and 4 parts by weight of rubber particles. The mixture is then cast onto a previously prepared surface of concrete, asphalt, timber, compacted earth or the like to form a layer of between 6 mm–20 mm in thickness. A pigmented (usually red iron oxide) surface coat of synthetic rubber or polyurethane polymer or a mixture thereof is then applied as both a decorative and wear layer.

Generally speaking these "solid" surfaces are used only as indoor sporting surfaces for indoor tennis. While quite effective initially as a surface for serious competition tennis, these surfaces nevertheless suffer a number of disadvantages. "Solid" polyurethane/rubber surfaces are extremely expensive due to the high polyurethane polymer content. In addition a "dog-bone" wear pattern develops between opposing base lines after a period of use. Apart from being unsightly when viewed by both live and television audiences, the dog-bone shaped depression gives rise to uneven ball bounce which is unacceptable to players.

Although attempts have been made to patch the dog-bone wear pattern by casting a fresh layer of polyurethane top coat into the depression, these attempts have been generally unsuccessful. When casting a fresh layer of top coat into the wear depression, it is very difficult to match the colour of the fresh layer to that of the surrounding original layer and thus the undesirable visual appearance of the dog-bone wear pattern can be worsened by repair. A particular disadvantage of such repair methods is that unless extreme caution is taken, delamination can occur between the original and repaired surfaces at the edges. This can be quite dangerous for players if they trip on a lifted edge.

Although the abovementioned problems may be avoided by casting a fresh layer of polyurethane resin over the entire surface of the tennis court, the high cost of materials is virtually prohibitive. This of course negates the possibility of frequent changes to the colour scheme of a tennis court as is often required for television purposes.

Another type of surface usually employed on outdoor tennis courts comprises a porous structure to assist in drainage of rainwater. The porous surface is constructed from a clear liquid polyurethane polymer containing rubber particles or other particulate materials. A porous structure is achieved by mixing the liquid polyurethane polymer and rubber particles in the ratio of about 1 part by weight of polymer and 5 parts by weight of rubber particles and applying the mixture to an outdoor surface to a thickness of between 6 mm–25 mm. The resultant structure when cured contains porous interstices between the polymer coated rubber particles and the structure is somewhat softer or more resilient than the solid structure.

Generally speaking such porous structures are more suited for running tracks and other athletic purposes rather than tennis courts. Porous structures of this type possess an irregular surface designed for maximum grip with an athlete's shoes and a regular ball bounce is usually not achievable. Accordingly such porous surfaces are unsuitable for serious competition tennis.

A major problem associated with outdoor porous sporting surfaces of this type is that the exposed surface undergoes degradation due to the effects of U.V. radiation and other weathering processes.

In maintenance of porous outdoor tennis surfaces it is necessary to mechanically abrade the weathered surface to remove the degraded polymer layer and then to recoat with a fresh layer of polyurethane resin containing rubber particles. This process is expensive in terms of labour and materials and usually results in a build-up of excess material thickness which in turn reduces the porosity of the surface.

Possibly the most widely employed "hard" synthetic surface comprises a relatively thin layer of pigmented acrylic polymer applied to say a concrete, asphalt or timber surface.

Acrylic surfaces are extremely durable, relatively inexpensive and suited to both indoor and outdoor use. Extremely high quality playing surfaces can be achieved with acrylic polymers.

Acrylic surfaces are easily recoated and colour changes may be readily effected as required. A particular advantage of acrylic surfaces is that one can readily "engineer" the surface characteristics to achieve a playing surface for tennis with a predetermined surface "speed".

Acrylic surfaces are also convenient in application in that they cure in less than one day compared with a seven day curing period for cushioned polyurethane surfaces.

The only real disadvantage of acrylic surfaces is that they require a very stable base as the tensile strength and elongation characteristics of an acrylic polymer film are not particularly good.

While it has been recently recognized that there would be a great advantage in combining a "cushioned" polyurethane sport surface with a durable acrylic "hard" top coat, previous attempts at this combination have not been successful.

The main reasons for failure have been due to the inherently poor adhesion between the polyurethane and conventional acrylic layers leading to bubbles and ultimately delamination. This is believed to be due to the chemical incompatibility of the cross-linked polyurethane and acrylic polymers which prevents a chemical bond between the layers.

Failure of the acrylic top coat is also believed to be due to a differential resilience between the respective layers particularly after prolonged exposure to sunlight. Tests have shown that the temperature of a cushioned polyurethane base can reach up to between 60° C.–80° C. at which temperature the base is very soft and resilient. Impact and scuffing from players' shoes leads to cracking and tearing of the acrylic wear surface due to different resiliencies.

Attempts to modify the resilience characteristics of acrylic wear layers by incorporation of internal or external plasticizers have also failed due to plasticizer migration and/or excessive softening of the acrylic wear layer.

It is an aim of the present invention to overcome or alleviate the problems of prior art synthetic sporting surfaces and to provide a relatively inexpensive surface which combines the best features of prior art "hard" and "cushioned" synthetic sports surfaces.

According to one aspect of the invention there is provided a method for constructing a synthetic sports surface comprising the steps of:

forming on a prepared surface a porous layer of polyurethane polymer containing particles of resilient material;

applying to an exposed surface of said porous layer a polymeric sealant to form a substantially sealed upper surface thereon;

forming on said substantially sealed surface a layer of fibre reinforced adhesive material, said adhesive material including a polymer having reactive sites capable of bonding to said substantially sealed surface and to a subsequently applied wear layer including an acrylic polymer; and, applying to the surface of said fibre reinforced adhesive material a wear layer comprising an acrylic polymer.

Suitably said porous layer comprises a matrix of rubber particles combined with a curable liquid polyurethane polymer in the ratio of 8–15 parts by weight of rubber particles and 2–5 parts by weight of a cross-linkable polyurethane elastomer.

Preferably the matrix comprises 5 parts by weight of rubber particles and 1 part by weight of a cross-linkable polyurethane elastomer.

The rubber particles may be of any suitable size, suitably particles having a diameter of from 0.5 mm–8 mm, but preferably 0.5 mm–5 mm.

The porous layer may be formed by any suitable means such as a paving apparatus, screeding or the like.

The polymeric sealant may comprise any suitable liquid curable polymer capable of bonding to the surface of the porous layer and substantially sealing the porous surface against ingress of liquid materials. Preferably the sealant comprises a coating of cross-linkable liquid polyurethane.

The sealant may be applied by any suitable means such as a spray gun, brush, squeegee or the like.

The fibre reinforced adhesive material may be formed by applying to the sealed surface a liquid polymer containing chopped strand fibres. Alternatively, the layer of fibre reinforced adhesive material may be formed byadhering to the sealed surface a layer of woven or non-woven fibrous cloth impregnated with polymeric adhesive. The polymeric adhesive may comprise a liquid polymer such as an aqueous latex and suitably the liquid polymer is comprised of flexible cross-linkable polyurethane or acrylic polymer or copolymer.

The fibre reinforced adhesive layer may be formed by spraying, painting, squeegeeing or the like and the fibrous reinforcing may be applied by a chopper gun or the like or alternatively, it may comprise a layer of pre- or post-impregnated woven or non-woven fabric impregnated with adhesive material. Suitably, fibrous reinforcing material employed in said fibre reinforced material is thermally stable in a temperature range of between −10° C. to 80° C. The fibrous reinforcing material may comprise glass, carbon, plastics and other synthetic fibres or natural fibres.

The wear layer may comprise a coating of pigmented acrylic polymer which may be applied to the adhesive layer in a conventional manner.

Suitably the acrylic wear layer comprises a conventional acrylic tennis court paving compound.

According to another aspect of the invention there is provided a synthetic sporting surface whenever made in accordance with the method according to the invention.

In order that the invention may be more clearly understood reference will now be made to a preferred embodiment illustrated in the accompanying drawing.

In the drawing the synthetic sports surface for tennis courts comprises a layer of porous polyurethane/particulate rubber matrix 1 formed on a pre-prepared support base 2. The support base 2 may comprise a concrete, asphalt or compacted earth base or for indoor use, it may be formed on a timber floor base.

The porous layer is substantially conventional in nature and comprises a mixture in the ratio of 5 parts by weight of granulated scrap rubber having an average particle diameter in the range 0.5 mm–5 mm mixed with 1 part by weight of "Aptane E603" (Trade Mark) a liquid polyurethane polymer available from Applied Polymers Pty. Ltd. After mixing, the fluid mass is applied to the ground surface to a thickness of between 8 mm–10 mm by a conventional paving machine of the type used to apply synthetic sporting surfaces. The base layer, in the form of a porous matrix is then allowed to cure or at least harden for a period of one day.

In an alternative embodiment, the base layer may comprise pre-formed "mats" of a suitable thickness. The preformed "mats" may be of any suitable planar shape such as squares, rectangles, hexagons or of irregular shape capable of interlocking to form a smooth substantially continuous surface.

After the base layer has stiffened or cured to a degree whereby it can be walked upon without permanently deforming the surface, a sealant 3 in the form of a two-part liquid polyurethane polymer or the like is brushed, sprayed or squeegeed over the surface of the base layer to seal the porous surface. A suitable sealant is "Aptane B610" (Trade Mark) available from Applied Polymers Pty. Ltd. As the purpose of the sealant 3 is simply to fill the surface interstices of the base layer, only sufficient material is applied to form a very thin layer of say less than 1 mm in thickness. The sealant layer 3 also serves to reduce to some extent imperfections in the base layer surface.

After the sealant layer 3 has been allowed to cure for one day, an acrylic based adhesive compound 4 is applied to the sealed base layer by spraying, brushing or squeegeeing to a thickness of about 1 mm. The acrylic based adhesive known as "Tycoat SRA 15" (Trade Mark) from A.V. Syntec Pty. Ltd. comprises a cross-linking ethyl hexyl butyl acrylate co-polymer having a molecular weight in the range $1-5\times10^6$ in an aqueous emulsion form with a solids content of about 60%.

While the adhesive layer is still wet, a one meter wide strip of 130 gsm non-woven fibreglass mat 5 are laid over the wetted surface of the court with adjacent edges overlapping by about 100 mm. The surface of the fibreglass is then rolled with a heavy roller to force portion of the still liquid adhesive layer below to penetrate and fully impregnate the fibreglass mat. A further layer 4*a* of acrylic adhesive is then applied to the upper surface of the fibreglass mat and rolled or squeegeed to ensure complete impregnation and encapsulation of the glass fibres.

The adhesive layer is then allowed to dry or cure for approximately one day depending upon weather conditions.

When the fibreglass reinforced adhesive layer has dried or cured to the required degree, a conventional pigmented acrylic latex tennis court surfacing compound 6 such as "Synpave Ace" (Trade Mark) from A.V. Syntec Pty. Ltd. is then applied in a conventional manner such as by brushing, spraying or squeegeeing and while wet, the surface is brushed with a stiff bristled broom to achieve a texture consistent with a required court "speed".

Tennis court line markings may then be applied to the acrylic top coat to achieve a tennis court having the desirable "cushioned" feel of a natural or synthetic sports surface in combination with the advantages of a durable and inexpensive acrylic "hard" sports surface but at the same time overcoming the disadvantages normally associated with prior art natural and synthetic "cushioned" sports surfaces.

The main requirement for a combination sports surface according to the invention is a good physical and/or chemical bond between the base surface and the reinforced adhesive layer and also between the adhesive layer and the acrylic top coat. To this end it will be appreciated that the first and second layers of adhesive compound which impregnate and encapsulate the fibrous reinforcing material may be the same material or differing materials.

In use it has been found that combination sports surfaces according to the invention maintain a consistent playing quality regardless of changes in conditions of sunshine, shade, ambient temperature and the like. Unlike prior art "cushioned" sports surfaces, the resilience of a combination surface remains substantially unchanged regardless of surface temperature variations from 10° C.–80° C. It is believed that the fibre reinforced adhesive layer between the "cushioned" base and the "hard" surface provides a very effective thermal barrier resulting in only minor temperature variations in the base layer despite significant variations in the surface temperature of the top coat.

It will be readily apparent to a skilled addressee that many modifications and variations may be made to the present invention without departing from the spirit and scope thereof.

I claim:

1. A method for constructing a synthetic sports surface comprising the steps of:

forming on a prepared surface a porous layer of polyurethane polymer containing particles of resilient material;

applying to an exposed surface of said porous layer a polymeric sealant to form a substantially sealed upper surface thereon;

forming on said substantially sealed surface a layer of fibre reinforced adhesive material, said adhesive material including a polymer having reactive sites capable of bonding to said substantially sealed surface and to a subsequently applied wear layer including an acrylic polymer; and, applying to the surface of said fibre reinforced adhesive material a wear layer comprising an acrylic polymer.

2. A method as claimed in claim 1 wherein said porous layer comprises a matrix of rubber particles combined with a curable liquid polyurethane polymer in the ratio of 8–15 parts by weight of rubber particles and 2–5 parts by weight of a cross-linkable polyurethane elastomer.

3. A method as claimed in claim 2 wherein said rubber particles have a diameter in the range of from 0.5 mm to 8 mm.

4. A method as claimed in claim 3 wherein the rubber particles have a diameter in the range of from 0.5 mm to 5 mm.

5. A method as claimed in claim 2 wherein said polymeric sealant comprises a cross-linkable liquid polyurethane.

6. A method as claimed in claim 5 wherein said layer of fibre reinforced adhesive material comprises glass fibres.

7. A method as claimed in claim 6 wherein said glass fibres are comprised in a non-woven cloth.

8. A method as claimed in claim 6 wherein said polymeric adhesive comprises an aqueous acrylic latex.

9. A method as claimed in claim 6 wherein said polymeric adhesive material comprises an aqueous polyurethane latex.

10. A method as claimed in claim 8 wherein said wear layer comprises a pigmented acrylic polymer.

11. A method as claimed in claim 1 wherein said porous layer of polyurethane is formed in situ on said prepared surface to form an integral layer.

12. A method as claimed in claim 1 wherein said porous layer of polyurethane is formed from preformed sheets of at least partially polymerized polyurethane polymer, said sheets being arranged in edge-to-edge abutting relationship to form a substantially continuous surface over said prepared surface.

13. A synthetic sports surface comprising a laminate of:

a porous resilient base layer formed from a matrix of a polyurethane elastomer and resilient particulate material;

a polymeric sealant on an upper surface of said base layer;

a fibre-reinforced adhesive layer on an upper surface of said sealant; and, a wear layer comprising an acrylic polymer on an upper surface of said sealant, said fibre-reinforced adhesive layer comprising an adhesive having reactive sites capable of bonding to said sealant and said wear layer.

* * * * *